US006867173B2

(12) United States Patent
Rodrigues

(10) Patent No.: US 6,867,173 B2
(45) Date of Patent: Mar. 15, 2005

(54) POLYMERS THAT INHIBIT CALCIUM PHOSPHATE AND CALCIUM CARBONATE SCALE IN AUTODISH APPLICATIONS

(75) Inventor: Klein A. Rodrigues, Signal Mountain, TN (US)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 32 days.

(21) Appl. No.: 10/239,047

(22) PCT Filed: Mar. 27, 2001

(86) PCT No.: PCT/US01/09863

§ 371 (c)(1),
(2), (4) Date: Mar. 17, 2003

(87) PCT Pub. No.: WO01/72941

PCT Pub. Date: Oct. 4, 2001

(65) Prior Publication Data

US 2004/0127377 A1 Jul. 1, 2004

Related U.S. Application Data

(60) Provisional application No. 60/193,014, filed on Mar. 29, 2000.

(51) Int. Cl.[7] ..... C11D 3/37; C11D 3/34; B08D 3/04

(52) U.S. Cl. ..... 510/223; 510/222; 510/229; 510/230; 510/466; 510/476; 510/477; 510/492; 510/533; 134/25.2; 134/25.3; 134/42

(58) Field of Search ..... 510/222, 223, 510/229, 230, 466, 476, 477, 492, 533; 134/25.2, 25.3, 42

(56) References Cited

U.S. PATENT DOCUMENTS

| | | | | | |
|---|---|---|---|---|---|
| 4,640,793 | A | | 2/1987 | Persinski et al. | 252/82 |
| 4,936,987 | A | | 6/1990 | Persinski et al. | 210/699 |
| 5,240,632 | A | | 8/1993 | Brumbaugh | 252/95 |
| 5,547,612 | A | | 8/1996 | Austin et al. | 134/22.19 |
| 5,958,855 | A | * | 9/1999 | Binstock et al. | 510/224 |
| 6,210,600 | B1 | * | 4/2001 | Zhou et al. | 252/180 |

FOREIGN PATENT DOCUMENTS

| | | | | |
|---|---|---|---|---|
| DE | 43 16 743 | | 11/1994 | C11D/3/37 |
| EP | 851022 | * | 7/1998 | C11D/3/37 |
| WO | WO 95/00624 | | 1/1995 | C11D/3/37 |
| WO | WO 95/32271 | | 11/1995 | C11D/3/37 |

* cited by examiner

*Primary Examiner*—Brian P. Mruk
(74) *Attorney, Agent, or Firm*—David P. LeCroy

(57) ABSTRACT

An automatic dishwashing composition is presented having 0.01 to 90 percent by weight of a detergency builder and 0.1 to 20 percent by weight of at least one polymer, wherein said polymer or polymers comprises carboxylate groups and sulfonate groups. The composition is useful in liquid, tablet and granular compositions. The composition reduces filming and spotting of glass and plastics.

13 Claims, No Drawings

POLYMERS THAT INHIBIT CALCIUM PHOSPHATE AND CALCIUM CARBONATE SCALE IN AUTODISH APPLICATIONS

This application claims benefit of application Ser. No. 60/193,014 filed Mar. 29, 2000.

TECHNICAL FIELD

This invention is in the field of liquid, tablet and granular automatic dishwashing compositions. More specifically, the invention relates to compositions containing detergent builders and a synergistic mixture of polymers, the mixture comprising at least one polymer containing carboxylate groups and at least one polymer containing sulfonate groups.

BACKGROUND OF THE INVENTION

Liquid, tablet and granular automatic dishwashing detergent components while necessary for various cleaning benefits, often can create other problems. For example, carbonate, and phosphate, conventional detergent ingredients, are known to contribute to formation of hard water deposits on glasses.

Organic dispersants can overcome the problem of unsightly deposits which form on china, especially on glassware, due to calcium- or magnesium-hardness-induced precipitation of pH-adjusting agents. However not all dispersants work as well on the various types of precipitation.

U.S. Pat. No. 5,240,632 teaches the use of the combination of protease enzymes, oxygen bleaches and polyacrylate polymers to reduce spots in autodish applications. U.S. Pat. No. 5,547,612 teaches the use of sulfonated polymers in detergent applications.

Although conventional low molecular weight polyacrylate homopolymers and some sulfonated polymers are somewhat effective in minimizing filming in automatic dishwashing detergent compositions, it has unexpectedly been found that mixtures of polymers containing carboxylate and sulfonate groups have a synergistic effect in enhancing filming performance in automatic dishwashing detergent compositions.

In addition, not only do mixtures of polymers containing carboxylate and sulfonate groups of the present invention prevent hard water filming due to precipitation but it has been surprisingly found that these polymers show improved spotting performance in automatic dishwashing detergent compositions.

SUMMARY OF THE INVENTION

The present invention encompasses a liquid, tablet or granular automatic dishwashing detergent composition comprising:

(a) from about 0.01% to about 90% detergency builder;
(b) from about 0.1% to about 20% of a mixture of polymers, the mixture comprising at least one polymer containing carboxylate groups and at least one polymer containing sulfonate groups.

DETAILED DESCRIPTION OF THE INVENTION

The present invention is a liquid or granular automatic dishwashing detergent composition comprising:

(a) from about 0.01% to about 90% by weight detergency builder;
(b) from about 0.1% to about 20% by weight of a mixture of at least one polymer containing carboxylate groups and at least one polymer containing sulfonate groups.

Compositions of the invention exhibit enhanced hard water filming performance and improved spotting performance by the presence of mixtures of these specific classes of polymers.

Polymers

The present invention can contain from about 0.1% to about 20%, preferably from about 1% to about 10%, most preferably from about 3% to about 8%, by weight of the automatic dishwashing detergent composition, of a mixture of polymers, the mixture comprising at least one polymer containing carboxylate groups and at least one polymer containing sulfonate groups.

The use of the polymers described herein provides a synergistic cleansing effect by virtue of the presence of both the polymer containing carboxylate groups and the polymer containing sulfonate groups. It is to be noted that the polymer containing sulfonate groups may, and preferably does, also contain carboxylate moieties.

Generally, the carboxylate containing polymer has 0.1 to 100 mole % of a carboxylic acid containing monomer or a olefinically unsaturated acid monomer. Useful olefinically unsaturated acids of this class include such widely divergent materials as the acrylic acid comonomers typified by acrylic acid itself, methacrylic acid, ethacrylic acid, alpha-chloroacrylic acid, alpha-cyano acrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, citraconic acid, mesaconic acid, glutaconic acid, aconitic acid, fumaric acid, and tricarboxy ethylene. For the polycarboxylic acid monomers, an anhydride group is formed by the elimination of one molecule of water from two carboxyl groups located on the same polycarboxylic acid molecule. The preferred carboxylic monomers for use in this invention are the monoolefinic acrylic acids having a substituent selected from the class consisting of hydrogen, halogen and hydroxyl groups, monovalent alkyl radicals, monovalent aryl radicals, monovalent aralkyl radicals, monovalent alkaryl radicals and monovalent cycloaliphatic radicals. As used herein, (meth)acrylic acid is intended to include acrylic acid and methacrylic acid.

The sulfonate containing polymer generally contains 0.1 to 100 mole % of a sulfonic acid containing monomer. Examples of such monomers are 2-acrylamido-2-methyl propane sulfonic acid, (meth)allyl sulfonic acid, styrene sulfonic acid, 1-allyloxy-2-hydroxypropane sulfonic acid, allyloxybenzene sulfonic acid, or salts thereof, and others.

The mixture of these polymers that may be used in the automatic dishwashing detergent composition may contain 1 to 99 wt % of the sulfonate polymer and, correspondingly, 99 to 1% of the carboxylate polymer. Preferably the mixture of these polymers that may be used in the automatic dishwashing detergent composition contains 25 to 75 wt % of the sulfonate polymer and 75 to 25% of the carboxylate polymer. Most preferably the mixture of these polymers that may be used in the automatic dishwashing detergent composition may contain 40 to 60 wt % of the sulfonate polymer and 60 to 40% of the carboxylate polymer.

Detergency Builder

The detergency builders used can be any of the detergency builders known in the art, which include the various water-soluble, alkali metal, ammonium or substituted ammonium phosphates, polyphosphates, phosphonates, polyphosphonates, carbonates, bicarbonates, borates, polyhydroxysulfonates, polyacetates, carboxylates (e.g. citrates), and polycarboxylates. Preferred are the alkali metal, especially sodium, salts of the above and mixtures thereof.

The amount of builder is from about 0.01% to about 90%, preferably from about 15% to about 80%, most preferably from about 15% to about 75% by weight of the automatic dishwashing detergent composition.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. A particularly preferred polyphosphonate builder component is ethane 1-hydroxy-1,1 diphosphonic acid or its alkali metal salts, which demonstrates calcium carbonate crystal growth inhibition properties, present at a level of from about 0.01% to about 20%, preferably from about 0.1% to about 10%, most preferably from about 0.2% to about 5% by weight of the compositions. Other phosphorus builder compounds are disclosed in U.S. Pat. Nos. 3,159,581; 3,213,030; 3,422,021; 3,422,137, 3,400,176 and 3,400,148, incorporated herein by reference.

Examples of non-phosphorus, inorganic builders are sodium and potassium carbonate, bicarbonate, sesquicarbonate and hydroxide. Water-soluble, non-phosphorus organic builders useful herein include the various alkali metal, ammonium and substituted ammonium polyacetates, carboxylates, polycarboxylates and polyhydroxysulfonates. Examples of polyacetate and polycarboxylate builders are the sodium, potassium, lithium, ammonium and substituted ammonium salts of ethylene diamine tetraacetic acid, nitrilotriacetic acid, tartrate monosuccinic acid, tartrate disuccinic acid, oxydisuccinic acid, carboxy methyloxysuccinic acid, mellitic acid, benzene polycarboxylic acids, and citric acid. The acidic forms of these builders can also be used, preferably citric acid.

Preferred detergency builders have the ability to remove metal ions other than alkali metal ions from washing solutions by sequestration, which as defined herein includes chelation, or by precipitation reactions. Sodium tripolyphosphate is typically a particularly preferred detergency builder material because of its sequestering ability. Sodium citrate is also a particularly preferred detergency builder, particularly when it is desirable to reduce or eliminate the total phosphorus level of the compositions of the invention.

Particularly preferred automatic dishwashing detergent compositions of the invention contain, by weight of the automatic dishwashing detergent composition, from about 5% to about 40%, preferably from about 10% to about 30%, most preferably from about 15% to about 20%, of sodium carbonate. Particularly preferred as a replacement for the phosphate builder is sodium citrate with levels from about 5% to about 40%, preferably from about 7% to 35%, most preferably from about 8% to about 30%, by weight of the automatic dishwashing detergent composition.

Detergent Surfactants

The compositions of this invention can contain from about 0.01% to about 40%, preferably from about 0.1% to about 30% of a detergent surfactant. In the preferred automatic dishwashing detergent compositions of the invention the detergent surfactant is most preferably low foaming by itself or in combination with other components (i.e. suds suppressors) is low foaming.

Compositions which are chlorine bleach free do not require the surfactant to be bleach stable. However, since these compositions contain enzymes, the surfactant employed is preferably enzyme stable (enzyme compatible) and free of enzymatically reactive species. For example, when proteases and amylases are employed, the surfactant should be free of peptide or glycosidic bonds.

Desirable detergent surfactants include nonionic, anionic, amphoteric and zwitterionic detergent surfactants, and mixtures thereof.

Examples of Nonionic Surfactants Include:

(1) The condensation product of 1 mole of a saturated or unsaturated, straight or branched chain, alcohol or fatty acid containing from about 10 to about 20 carbon atoms with from about 4 to about 40 moles of ethylene oxide. Particularly preferred is the condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9 moles of ethylene oxide. These various specific $C_{17}$–$C_{19}$ ethoxylates give extremely good performance even at lower levels (e.g., 2.5%–3%). At the higher levels (less than 5%), they are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 7,500; 6,000; 4,500; 3,400; and 1,450. All of these materials are wax-like solids which melt between 110.degree. F. (43.degree. C.) and 200.degree. F. (93.degree. C.).

(3) The condensation products of 1 mole of alkyl phenol wherein the alkyl chain contains from about 8 to about 18 carbon atoms and from about 4 to about 50 moles of ethylene oxide.

(4) Polyoxypropylene, polyoxyethylene condensates having the formula $HO(C_2H_6O)_x(C_3H_6O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the PLURONICS.RTM. from BASF which are well known in the art.

(5) the compounds of (1) and (4) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ wherein R is an alkyl or alkylene group containing from 17 to 19 carbon atoms, x is a number from about 6 to about 15, preferably from about 7 to about 12, and R' is selected from the group consisting of: hydrogen, $C_{1-5}$ alkyl groups, $C_{2-5}$ acyl groups and groups having the formula $—(C_y H_{2y} O)_n H$ wherein y is 3 or 4 and n is a number from one to about 4.

Particularly suitable surfactants are the low-sudsing compounds of (4), the other compounds of (5), and the $C_{17}$-$C_{19}$ materials of (I) which have a narrow ethoxy distribution. Certain of the block co-polymer surfactant compounds designated PLURONIC.RTM., PLURAFAC.RTM. and TETRONIC.RTM. by the BASF Corp., Parsippany, N.J. are suitable as the surfactant for use herein. A particularly preferred embodiment contains from about 40% to about 70% of a polyoxypropylene, polyoxethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Additional nonionic type surfactants which may be employed have melting points at or above ambient temperatures, such as octyldimethylamine N-oxide dihydrate, decyldimethylamine N-oxide dihydrate, $C_8$–$C_{12}$ N-methyl-glucamides and the like. Such surfactants may advantageously be blended in the instant compositions with short-chain anionic surfactants, such as sodium octyl sulfate and similar alkyl sulfates, though short-chain sulfonates such as sodium cumene sulfonate could also be used.

In addition to the above mentioned surfactants, other suitable surfactants for detergent compositions can be found in the disclosures of U.S. Pat. Nos. 3,544,473, 3,630,923, 3,88,781, 4,001,132, and 4,375,565 all of which are incorporated herein by reference.

Anionic surfactants which are suitable for the compositions of the present invention include, but are not limited to, water soluble-alkyl sulfates and/or sulfonates, containing from about 8 to about 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures thereof. Highly preferred alkyl sulfates are sodium coconut alkyl sulfate, potassium coconut alkyl sulfate, potassium lauryl alkyl sulfate and sodium lauryl alkyl sulfate.

A preferred sulfonated anionic surfactant is the alkali metal salt of secondary alkane sulfonates, an example of which is the Hostapur SAS from Hoechst Celanese.

Another class of surfactants operable in the present invention are the water-soluble betaine surfactants. These materials have the general formula:

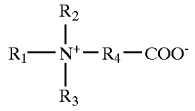

wherein $R_1$ is an alkyl group containing from about 8 to 22 carbon atoms;

$R_2$ and $R_3$ are each lower alkyl groups containing from about 1 to 5 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanoate and tetradecyldipropylammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Other surfactants include amine oxides, phosphine oxides, and sulfoxides. However, such surfactants are usually high sudsing. A disclosure of surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable surfactants are the alkyl phosphonates, taught in U.S. Pat. No. 4,105,573 to Jacobsen issued Aug. 8, 1978, incorporated herein by reference.

Still other preferred anionic surfactants include the linear or branched alkali metal mono- and/or di-($C_{8-14}$) alkyl diphenyl oxide mono- and/or disulfonates, commercially available under the trade names DOWFAX.RTM. 3B-2 (sodium n-decyl diphenyloxide disulfonate) and DOWFAX.RTM. 2A-1. These and similar surfactants are disclosed in published U.K. Patent Applications 2,163,447A; 2,163,448A; and 2,164,350A, said applications being incorporated herein by reference.

Some of the above-described detergency builders additionally serve as buffering agents. It is preferred that the buffering agent contain at least one compound capable of additionally acting as a builder.

Silicate

The compositions of the type described herein deliver their bleach and alkalinity to the wash water very quickly. Accordingly, they can be aggressive to metals, dishware, and other materials, which can result in either discoloration by etching, chemical reaction, etc. or weight loss. The alkali metal silicates described hereinafter provide protection against corrosion of metals and against attack on dishware, including fine china and glassware.

The $Sio_2$ level in the compositions of the present invention should be from about 4% to about 25%, preferably from about 5% to about 20%, more preferably from about 6% to about 15%, based on the weight of the automatic dishwashing detergent composition. The ratio of $SiO_2$ to the alkali metal oxide ($M_2O$, where M=alkali metal) is typically from about 1 to about 3.2, preferably from about 1.6 to about 3, more preferably from about 2 to about 2.4. Preferably, the alkali metal silicate is hydrous, having from about 15% to about 25% water, more preferably, from about 17% to about 20%.

The highly alkaline metasilicates can be employed, although the less alkaline hydrous alkali metal silicates having a $SiO_2$:$M_2O$ ratio of from about 2.0 to about 2.4 are preferred. Anhydrous forms of the alkali metal silicates with a $SiO_2$:$M_2O$ ratio of 2.0 or more are less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PO Corporation, named Britesil H20 and Britesil H24. Most preferred is a granular hydrous sodium silicate having a $SiO_2$:$Na_2O$ ratio of 2.0.

While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Bleaches.

Bleaches may also be used in these dishwashing detergents. Useful bleaches include halogen, peroxide and peracid bleaches such as sodium chlorite, sodium hypochlorite, sodium dichloroisocyanurate, sodium perborate and sodium percarbonate, and the corresponding potassium salts. The bleaches may be present at levels of from 0 to 20% by weight, preferably from 0.5 to 15% by weight, based on the total weight of the detergent composition. Bleach activators may be included in the detergent compositions of the present invention; such bleach activators are chosen to optimize bleaching at low temperatures, and include such materials as N,N,N',N'-tetraacetylethylene diamine, sodium nonyloxybenzene sulfonate, glucose pentaacetate and tetraacetyl glycouril. Selection of the bleach activator appropriate to the bleach chosen is within the capability of one having ordinary skill in the art.

The automatic dishwashing detergent compositions of the present invention may also include up to 5% by weight of conventional adjuvants such as fragrances, dyes, foam suppressants, detersive enzymes such as proteolytic enzymes and amylases, antibacterial agents and the like. When the detergent is in the liquid form, from 0 to 5% by weight, based on the total weight of the ADD composition, of stabilizers or viscosity modifiers, such as clays and polymeric thickeners, may be present. Additionally, inert diluents, as for example inorganic salts such as sodium or potassium sulfate or chloride, and water may be present.

The components selected for the detergent compositions are preferably compatible with one another. For example, dyes, fragrances and enzymes are preferably compatible with bleach components and alkaline components, both during storage and under use conditions. It is within the ability of one having ordinary skill in the art to select components of the detergent compositions that are compatible with one another.

EXAMPLE 1

Synthesis of a Polymer Containing Sulfonate Groups

A sample of sulfophenyl methallyl ether weighing 72 grams and 36.9 grams of sodium methallyl sulfonate was stirred into 390 grams of water and 133 grams of isopropanol in a 2 liter reaction vessel and heated to 85° C. A dilute solution containing 0.0083 grams of ferrous ammonium sulfate hexahydrate was added to the reactor. A monomer solution that consisted of a mixture of 200 grams of acrylic acid, 45.4 grams of methyl methacrylate and 16.4 grams of a 50% solution of 2-acrylamido-2-methyl propane sulfonic acid was added over a 3 hour period. 14.8 grams of sodium persulfate was dissolved in 69 grams of water and added to the reactor over a period of three hours and 30 minutes concurrent with the mixed monomer feed, except for the additional 30 minutes to react any residual monomer. The reaction mixture was held at 85° C. for 1 hour. A solution of 0.45 grams of erythorbic acid dissolved in 2.1 grams of water was then added. The reactor was set up for distillation and a mixture of isopropanol and water that weighed 225 grams was distilled off. The reaction product was then cooled and 200 grams of a 50% solution of sodium hydroxide was added. The final product was a clear yellow aqueous solution with approximately 40 percent solids and a pH of around 7.0

EXAMPLE 2

Synthesis of a Polymer Containing Carboxylate Groups (No Sulfonate Groups)

A sample of ferrous ammonium sulfate, hexahydrate weighing 0.0085 grams was stirred into 146.0 grams of water in a two liter reaction vessel and heated to 96° C. A solution of 5.4 grams of sodium persulfate dissolved in water was pumped in to the reactor over a period of 4 hours and 40 minutes. At the same time, 105 grams of a 41% solution of sodium bisulfite was pumped in to the reactor over a 4 hour and 12 minute period. After 10 minutes, 260 grams of acrylic acid were slowly added to the reactor using a pump over a four hour period. The reaction mixture was then cooled to 85° C. and 6.0 grams of a 35% solution of hydrogen peroxide was added to the reactor. The reaction mixture was then held at 85° C. for a period of 30 minutes. The reaction mixture is then cooled and 104 grams of water and 270.6 grams of 50% solution of sodium hydroxide were then added. The final product was a clear light amber color solution with a pH of 8.0 and containing 40% solids.

EXAMPLE 3

Mixture of Polymers Containing Carboxylate and Sulfonate Groups

A sample containing 100 grams of the polymer solution of Example 1 was mixed with 100 grams of a polymer solution of example 2 and stirred for 30 minutes. The resulting mixture was an aqueous yellow solution containing 40% solids.

EXAMPLE 4

The polymers synthesized in Examples 1, 2 and 3 were tested in a automatic dishwasher using the ASTM D3556-85 (reapproved in 1995). The test used a mixture of glasses and plastic tumblers. The soil was 80% margarine and 20% dry milk, which was blended and then, smeared on to the surface of the glasses. The soil loading was 40 grams per load. The detergent loading was 40 grams of a generic detergent (BI-LO). The water hardness was 350 ppm with a Ca to Mg ratio of 2:1. The test used 3% active polymers synthesized in Examples 1, 2 and 3. The visual results of the testing after a total of 3 wash cycles are listed in Table 1.

TABLE 1

Visual results of the autodish tests conducted on polymers of Example 1, 2 and 3. The filming and spotting were visually rated on a scale of 1 to 10 with 10 being the worst and 1 being the best

| Polymer | Polymer Description | Filming | Spotting |
|---|---|---|---|
| Example 1 | Sulfonate polymer | 3 | 3 |
| Example 2 | Carboxylate polymer | 2 | 3 |
| Example 3 | Synergistic blend of carboxylate and sulfonate polymer | 1 | 1 |

The results in Table 1 clearly illustrate an unexpected synergy in the mixture of the sulfonate and carboxylate polymer. The performance of the mixture of polymers is clearly superior to the performance of the individual polymers of the mixture when compared on an equal end use level.

EXAMPLE 5

The performance of two samples of an auto-dishwashing detergent were compared in a dishwashing machine. Sample A (control) consisted of a modified IEC 436 Reference detergent as follows:

| Ingredient | % |
|---|---|
| THERMOPHOS NW | 18.0 |
| PLURAFAC LF 403 | 0.75 |
| Sodium dichlorisocyanurate | 1.73 |
| Sodium carbonate | 8.0 |
| Sodium metasilicate | 16.5 |
| Sodium metasilicate pentahydrate | 27.8 |
| Sodium sulfate | 25.0 |

Sample B contained the detergent A plus 4 percent by weight of the polymer of Example 1, based on the weight of detergent. The polymer was added in the pre-wash and main wash cycles. The same test was used as in example 4, with 80 grams of the margarine/milk mixture. The water contained 350 ppm hardness. 5 wash cycles were run, with a grading after each cycle (based on visual results on a scale of 0 to 5, with 5 being the best.) The test used 6 glass tumblers and 1 plastic tumbler.

| TEST | Sample | Cycle 1 | Cycle 2 | Cycle 3 | Cycle 4 | Cycle 5 |
|---|---|---|---|---|---|---|
| Glass Spotting | A | 1.8 | 1.3 | 0.9 | 0.6 | 0.3 |
| | B | 2 | 2.2 | 2.3 | 4.4 | 3.6 |
| Glass Filming | A | 4.5 | 3.75 | 3 | 2 | 1.2 |
| | B | 4.5 | 4.5 | 4 | 3.5 | 2.5 |
| Plastic Spotting | A | 0.8 | 0.8 | 0.3 | 0.2 | 0.7 |
| | B | 0.5 | 3 | 3 | 2.5 | 2 |
| Plastic Filming | A | 2 | 0.5 | 0.5 | 0.5 | 0.5 |
| | B | 5 | 4 | 3 | 2 | 1 |

What is claimed is:

1. An automatic dishwashing composition comprising:

0.01 to 90 percent by weight of a detergency builder, and 0.1 to 20 percent by weight of a mixture at least one polymer having carboxylate groups without any sulfonate groups and at least one polymer having sulfonate groups.

2. The automatic dishwashing composition of claim 1 comprising from 1 to 10 percent by weight of the mixture polymers.

3. The automatic dishwashing composition of claim 1 comprising from 3 to 8 percent by weight of the mixture of polymers.

4. The automatic dishwashing composition of claim 1 wherein said at least one polymer having sulfonate groups further comprises carboxylate groups on said at least one polymer.

5. The automatic dishwashing composition of claim 1 wherein said at least one polymer having carboxylate groups is polymerized from a monomer mixture comprising at least one monoolefinic acrylic acid.

6. The automatic dishwashing composition of claim 1 wherein said at least one polymer having sulfonate groups is polymerized from a monomer mixture comprising at least one sulfonic acid containing monomer.

7. The automatic dishwashing composition of claim 1 wherein said polymers comprises carboxylate and sulfonate groups in a ratio of from 1:99 to 99:1.

8. The automatic dishwashing composition of claim 1 wherein said polymers comprises carboxylate and sulfonate groups in a ratio of from 75:25 to 25:75.

9. The automatic dishwashing composition of claim 1 wherein said polymers comprises carboxylate and sulfonate groups in a ratio of from 40:60 to 60:40.

10. The automatic dishwashing composition of claim 1 comprising 15 to 80 percent by weight of said detergency builder.

11. The automatic dishwashing composition of claim 1 wherein said detergency builder comprises sodium tripolyphosphate, sodium citrate, sodium carbonate or a mixture thereof.

12. The automatic dishwashing composition of claim 1 further comprising surfactants, silicates, bleaches or mixtures thereof.

13. A process for washing dishes, china, or tableware comprising:

loading the dishes, china or tableware in an automatic dishwashing machine; and contacting said dishes, china or tableware with water and the automatic dishwashing composition of claim 1.

* * * * *